US006874333B2

(12) United States Patent
Fjaestad et al.

(10) Patent No.: US 6,874,333 B2
(45) Date of Patent: Apr. 5, 2005

(54) REFRIGERATOR OR FREEZER CABINET

(75) Inventors: Adam Fjaestad, Stockholm (SE); Lennart Johansson, Bromma (SE); Stefan Jonsson, Stockholm (SE); Håkan Miefalk, Järfälla (SE)

(73) Assignee: Aktiebolaget Electrolux, Stockholm (SE)

( * ) Notice: Subject to any disclaimer, the term of this patent is extended or adjusted under 35 U.S.C. 154(b) by 72 days.

(21) Appl. No.: 10/343,033

(22) PCT Filed: Aug. 1, 2001

(86) PCT No.: PCT/SE01/01695

§ 371 (c)(1),
(2), (4) Date: Feb. 24, 2003

(87) PCT Pub. No.: WO02/12809

PCT Pub. Date: Feb. 14, 2002

(65) Prior Publication Data

US 2004/0065108 A1 Apr. 8, 2004

(30) Foreign Application Priority Data

Aug. 9, 2000 (SE) ..... 0002858

(51) Int. Cl.[7] ..... F25D 17/04; F25D 11/00
(52) U.S. Cl. ..... 62/407; 62/440
(58) Field of Search ..... 62/407, 440, 441, 62/515; 165/146

(56) References Cited

U.S. PATENT DOCUMENTS

| | | | |
|---|---|---|---|
| 2,251,907 | A | 8/1941 | Hoesel |
| 2,584,442 | A | 2/1952 | Frie |
| 3,831,670 | A | 8/1974 | Mullings |
| 4,534,410 | A | 8/1985 | Watabe et al. |
| 5,067,322 | A | 11/1991 | Beers |
| 5,157,941 | A | 10/1992 | Cur et al. |
| 5,713,215 | A | 2/1998 | Choi |
| 5,720,186 | A | 2/1998 | Brown et al. |

*Primary Examiner*—Chen Wen Jiang
(74) *Attorney, Agent, or Firm*—Pearne & Gordon LLP

(57) ABSTRACT

At a refrigerator or freezer cabinet (10) with a space for storing goods, an evaporator (38) extends along the rear wall (18) of the cabinet and confines in sidewards direction a chamber (52), which is also confined by the rear wall (18) and an intermediate wall (44) arranged in front of the rear wall. An opening (54) is arranged in the intermediate wall (44), through which opening an impeller (56) sucks in air from the space and blows the air out into the chamber (52), the cross sectional area of which decreasing in vertical direction so that the air is evenly distributed along the evaporator (38) before the air in sidewards direction passes through the evaporator out into the space along the rear wall, from where the air circulates further on through the space between shelves located therein back to the opening (54).

6 Claims, 2 Drawing Sheets

REFRIGERATOR OR FREEZER CABINET

This application claims the benefit of International Application Number PCT/SE01/01695, which was published in English on Feb. 14, 2002.

BACKGROUND OF THE INVENTION

The invention refers to a refrigerator or freezer cabinet with a space for goods, which space is confined by a rear wall, two side walls, a top wall, a bottom wall and a door, an element for refrigerating air circulated through the element by an impeller of a fan, which air is circulated further on through the space in order to thereby refrigerate the goods.

BRIEF SUMMARY OF THE INVENTION

The object of the invention is to, at such a cabinet, bring about an even distribution of the air flowing through the space for refrigerating the goods simultaneously as the means for achieving the circulation of air take a minimum of space.

This object is reached by the cabinet according to the invention thereby that the element extends along the rear wall and confines in sidewards direction a chamber, which is furthermore confined by the rear wall and an intermediate wall arranged in front of the rear wall, an opening being arranged in the intermediate wall and the impeller sucking in air from the space through the opening, from where the impeller blows the air out into the chamber, the cross sectional area of which decreasing in vertical direction so that the air is evenly distributed along the element before it in sidewards direction passes through the element out into the space along the rear wall, from where the air circulates further on through the space between shelves located therein back to the opening.

BRIEF DESCRIPTION OF THE DRAWINGS

Embodiments of a refrigerator or freezer cabinet according to the invention are described below in connexion with the enclosed drawing, in which.

DETAILED DESCRIPTION OF THE INVENTION

Figure 1:
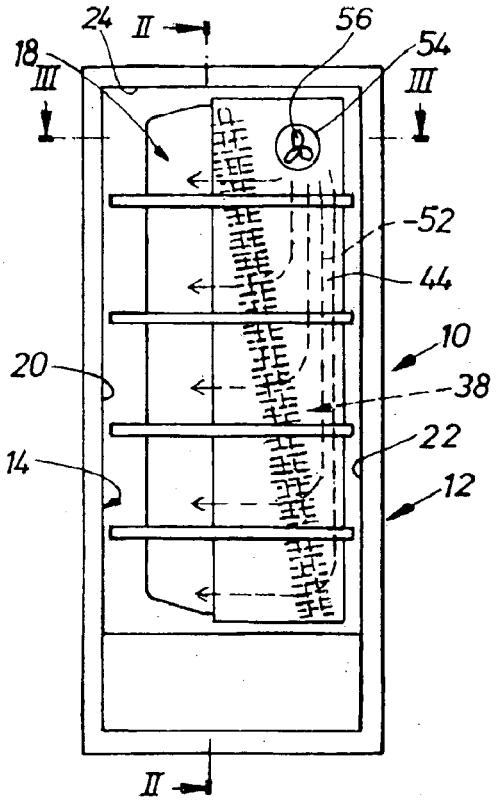
FIG. 1 shows a front view of a cabinet with the door removed and with shelves and an intermediate wall, which covers an evaporator.
Figure 2:
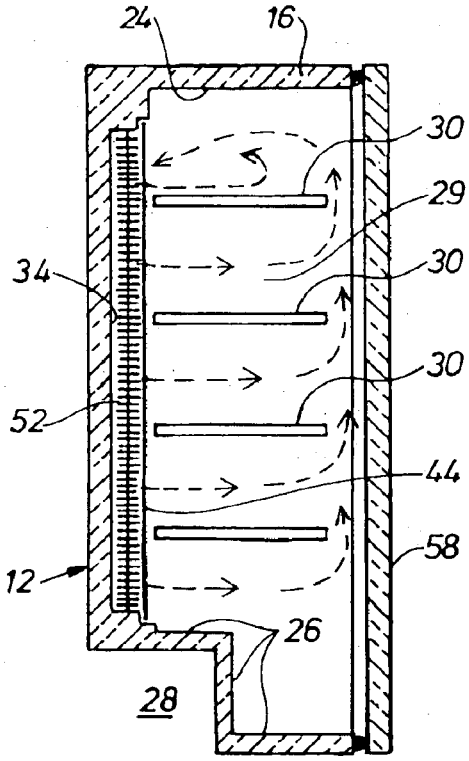
FIG. 2 shows a sectional view according to the marking II—II in FIG. 1.
Figure 3:
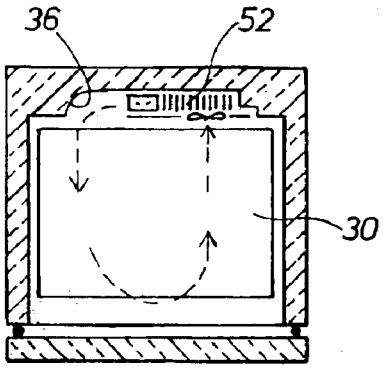
FIG. 3 shows a sectional view according to the marking III—III in FIG. 1.
Figure 4:
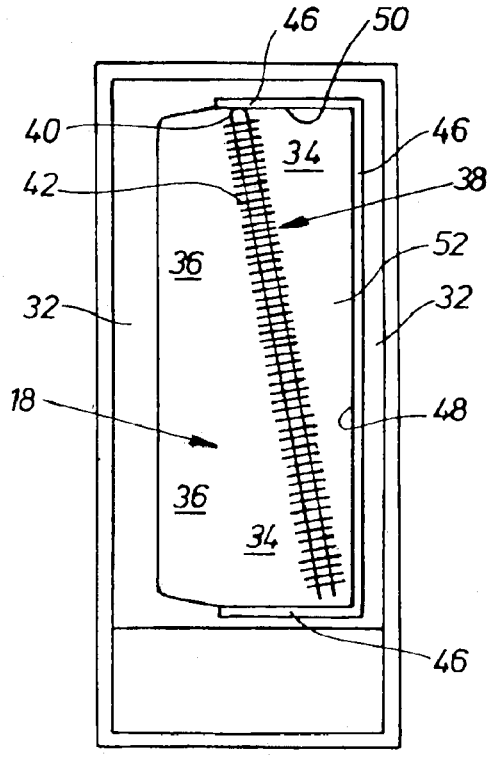
FIG. 4 shows the same view as FIG. 1 but with the shelves and the intermediate wall removed.

With reference to FIGS. 1–4 numeral 10 designates a refrigerator or freezer cabinet constituted by an outer shell 12 of iron plate or plastic and an inner shell 14 of plastic, a heat insulation 16 being in customary way arranged between the shells. The inner shell 14 has a rear wall 18, two side walls 20 and 22, respectively, a top wall 24 and a bottom wall 26, behind which a room 28 is arranged for housing a refrigerating apparatus (not shown). Said walls enclose a space 29 with a plurality of shelves 30 for storing goods.

The rear wall 18 has a plane part 32 and a depressed part with a plane, rectangular bottom 34, which merges in the part 32 by means of a vaulted part 36. A straight and long and narrow evaporator 38 constituted by a tube 40 bent to U-shape and with flanges 42 is arranged diagonally on the bottom 34. The evaporator 38 and the bottom 34 is covered by a rectangular intermediate wall 44, which is parallel with the bottom 34 and along three of its edges rests in a band-shaped depression 46 of the part 32. Between the evaporator 38, the bottom 34, the intermediate wall 44 and a vertical 48 and horizontal 50 part of the wall 18 thus a wedge-shaped chamber 52 is formed, the cross sectional area of which decreasing in downwards direction. The intermediate wall 44 extends about 60% of the distance between the side walls 22 and 20, respectively.

The top part of the intermediate wall 44 has an opening 54, in which an electrically driven impeller 56 of a fan is arranged to suck in air from the space 29 and blow the air out into the chamber 52, in which the air by the wedge-shape of the chamber in a way known per se in flow contexts will distribute evenly along the evaporator and after that flow in sidewards direction through the evaporator with a flow which is evenly distributed along the whole length of the evaporator and is directed out between the shelves 30 in the space 29 by the vaulted surface 36. The air then flows towards the front edge of the respective shelf, here it turns off upwards and flows along a door 58 of the cabinet back to the opening 54.

Figure 5:
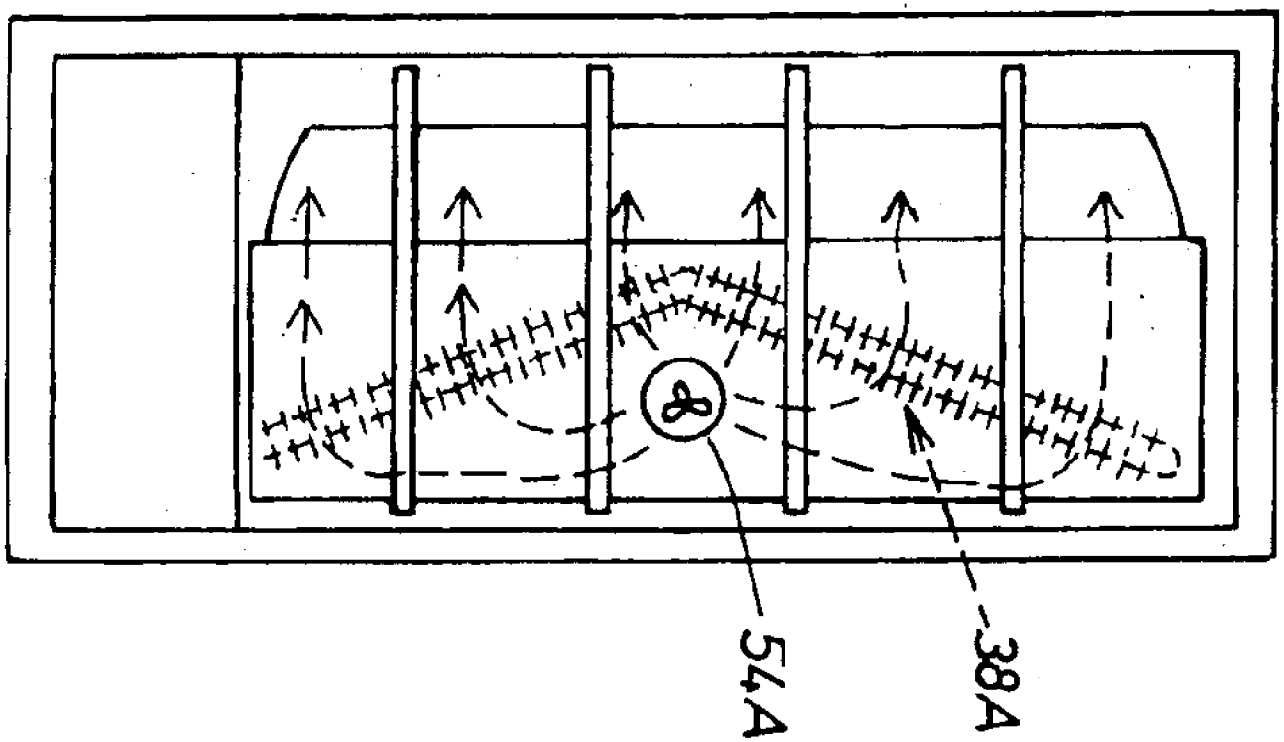
FIG. 5 shows a variant of the embodiment according to FIGS. 1–4, the evaporator having V-shape.

The opening 54 can be located on different levels in the intermediate wall 44. At the embodiment according to FIG. 5 the opening 54A is located at about half the height of the intermediate wall, the even distribution of the air being brought about by the evaporator 38A having been given the shape of a V, the point of which being located on level with the opening 54A.

The flow path of the air is in the figures shown with broken arrows.

What is claimed is:

1. Refrigerator or freezer cabinet (10) comprising:

a space (29) for goods, which space is confined by a rear wall (18), first and second side walls (20 and 22), a top wall (24), a bottom wall (26) and a door (58);

a chamber defined by the rear wall (18) and an intermediate wall arranged in front of the rear wall;

an impeller (56) of a fan for circulating air through the space (29);

an element (38; 38A) for refrigerating the air circulated through the element by the impeller (56) in order to thereby refrigerate the goods, wherein the element (38; 38A) extends horizontally along the rear wall (18);

a chamber (52) defined by the element (38; 38A), the rear wall (18) and an intermediate wall (44) arranged in front of the rear wall;

an opening (54; 54A) in the intermediate wall (44), wherein the impeller (56) sucks in air from the space (29) through the opening (54; 54A) and into the chamber (52); and shelves (30) located within the space;

wherein the cross sectional area of the chamber decreases in a vertical direction so that the air is evenly distributed along the element (38; 38A) before passing horizontally through the element out into the space (29) along the rear wall, then between the shelves (30), and then back to the opening (54).

2. The cabinet according to claim 1, wherein the intermediate wall (44) is substantially parallel with the rear wall (18) and the element (38; 38A) is covered by the intermediate wall (44).

3. The cabinet according to claim 2, wherein the element (38) has a long and narrow shape and the opening (54) is located in an upper part of the intermediate wall (44).

4. The cabinet according to claim 3, wherein the intermediate wall (44) extends about 60% of a distance between the first and second side walls (20 and 22).

5. The cabinet according to claim 2, wherein the element (38A) has the shape of a V and the opening (54A) is located proximate to a point of said V.

6. The cabinet according to claim 1, wherein the intermediate wall (44) has a substantially rectangular shape and extends from the bottom wall (26) to the top wall (24) and from the second side wall (22) towards the second side wall (20), so that the intermediate wall covers a part of the rear wall (18).

* * * * *